US007423210B2

(12) United States Patent
Marwede

(10) Patent No.: US 7,423,210 B2
(45) Date of Patent: Sep. 9, 2008

(54) DRUM AND DRUM ASSEMBLAGE

(76) Inventor: Leif Pran Marwede, 573 Summergrove Ct., Suwanee, GA (US) 30024

( * ) Notice: Subject to any disclaimer, the term of this patent is extended or adjusted under 35 U.S.C. 154(b) by 15 days.

(21) Appl. No.: 11/448,430

(22) Filed: Jun. 7, 2006

(65) Prior Publication Data

US 2007/0017335 A1 Jan. 25, 2007

(51) Int. Cl.
*G10D 13/02* (2006.01)

(52) U.S. Cl. ..... 84/411 R

(58) Field of Classification Search ..... 84/41 R, 84/421, 411 R, 411 P, 420
See application file for complete search history.

(56) References Cited

U.S. PATENT DOCUMENTS 4,170,162 A * 10/1979 Casavant ..... 84/453
6,586,666 B2 * 7/2003 Abe ..... 84/477 R
6,756,140 B1 6/2004 McAlister

FOREIGN PATENT DOCUMENTS

JP 402187792 A * 7/1990 ..... 84/411 R

* cited by examiner

*Primary Examiner*—Kimberly R Lockett

(57) ABSTRACT

A drum has a sound reflector at the lower end of its shell for reflecting sound waves back toward the drumhead, thereby improving the quality and duration of the sound. The shell may be mounted from a base plate that provides an annular reflecting flange. Multiple drums, e.g., four, may be mounted from a single baseplate.

3 Claims, 4 Drawing Sheets

DRUM AND DRUM ASSEMBLAGE

The present invention relates to drums, such as those that might be carried by a marching band, and to assemblages of such drums.

BACKGROUND OF THE INVENTION

A typical drum, such as a drum played by a drummer in a marching band, has a drum head mounted atop a cylindrical drum shell. The drum head typically consists of a membrane of animal skin or synthetic material with an annular metal flange defining the circular shape of the drum head and providing means for mounting the drum on the cylindrical drum shell. Mounted on the sides of the drum shell are a plurality of lug casings. Common drum sizes are from 6" to 14". The typical number of lug casings on a 6" drum is 4 lug casings; 8" drum, 5 or 6 lug casings; 10" drum, 6 lug casings; and 12", 13" and 14" drums 8 lug casings. With the drum head mounted on the drum shell, a drum rim is placed over the metal flange of the drum head and secured to the lug casings with tension rods. The bottom of the drum shell is open for transmission of sound waves.

The drum shell contains a cylindrical column of air that resonates when the sounding membrane is struck, contributing to the duration, volume and quality of the sound. The cylindrical drum shell must have sufficient height, providing a sufficiently long air column, to provide the desired sound. For a marching band drum, the height of a typical drum shell is between 6 and 14 inches.

A marching band drummer will typically carry, e.g., by means of a harness assembly, an assemblage of drums that are mechanically joined together. A common drum assemblage carried by a marching drummer has four primary drums, each of different pitch. For this reason, the assemblage is commonly called a "quad", although the assemblage may also contain additional, usually smaller, drums for special effects.

A quad drum assemblage may become somewhat weighty, 36 to 45 pounds (approximately 15-20 kilograms) being typical, and carrying this weight is a meaningful burden on the drummer. Furthermore, the assemblage, that must be transported from location to location, e.g., in a case, is quite bulky.

Of primary concern, of course, is the sound of the drum. As noted above, the resonating of air within the drum shell contributes to the duration, volume, and quality of the sound. It is a primary object of the present invention to provide drums with improved sound quality. It is further an object of the invention to provide smaller and lighter drums and drum assemblages.

SUMMARY OF THE INVENTION

In accordance with the invention, there is provided at the lower end of a drum shell a reflector that partially occludes the lower open end of a drum shell and redirects a portion of the resonating air in the drum shell back upward toward the drum head. Sound waves reflecting back upwards create constructive interference, increasing the total duration and quality of sound. The result is a better sound upon striking the drum. Because the reflector contributes significantly to resonance within the drum shell, much shorter shells can be used and still achieve high quality sound. Drum shells as short as 1 to 4 inches (2.5-10 cm.) may be used in marching band drums having sound reflectors in accordance with the invention.

In one aspect of the present invention, the drum shell is mounted on a base plate that has a circular opening smaller than the interior diameter of the drum shell (or lower end of the drum shell if the drum shell is frustoconical). With the drum shell centered about this opening, an annular flange of the base plate constricts the opening of the drum shell to the smaller diameter of the base plate opening. In this aspect of the invention, the annular flange serves as the sound reflector.

The base plate further extends outward of the drum shell, providing a means of attaching the drum rim directly to the base plate, e.g., by bolting tension rods directly through bores provided in the base plate. This obviates the need for lug casings. As a four-drum assembly will typically have thirty two of these lug casings, and as additional "effects" drums add corresponding additional lug casings, the weight of each drum and particularly drum assemblages may be significantly reduced.

As a further aspect of the invention, each of an assemblage of drums may be mounted from a common base plate, whereby an integral part of each drum also serves as the mechanical means for connecting an assemblage of drums.

While the sound reflectors, such as the reflecting flanges, allow for shorter drum shells, it is contemplated in certain situations that longer resonating chambers may still be desired. In one aspect of the present invention, the base plate and its opening provide means of attachment of cylindrical (or frustoconical) extenders at the bottom of the base plate. These extenders are preferably attachable and removable from the base plate, whereby the assemblage, absent the extenders, may be stored and shipped in smaller cases or multiple assemblages may be carried in an existing case currently designed for carrying a single assemblage.

DETAILED DESCRIPTION OF CERTAIN PREFERRED EMBODIMENTS

Many of the advantages of the invention are particularly pertinent to an assemblage of drums, such as a quad assemblage, and the invention will be described hereinbelow with respect to such an assemblage. However, it is to be understood that advantages of the invention also apply to a single drum or other assemblages, such as might be used in an orchestra.

Figure 1:
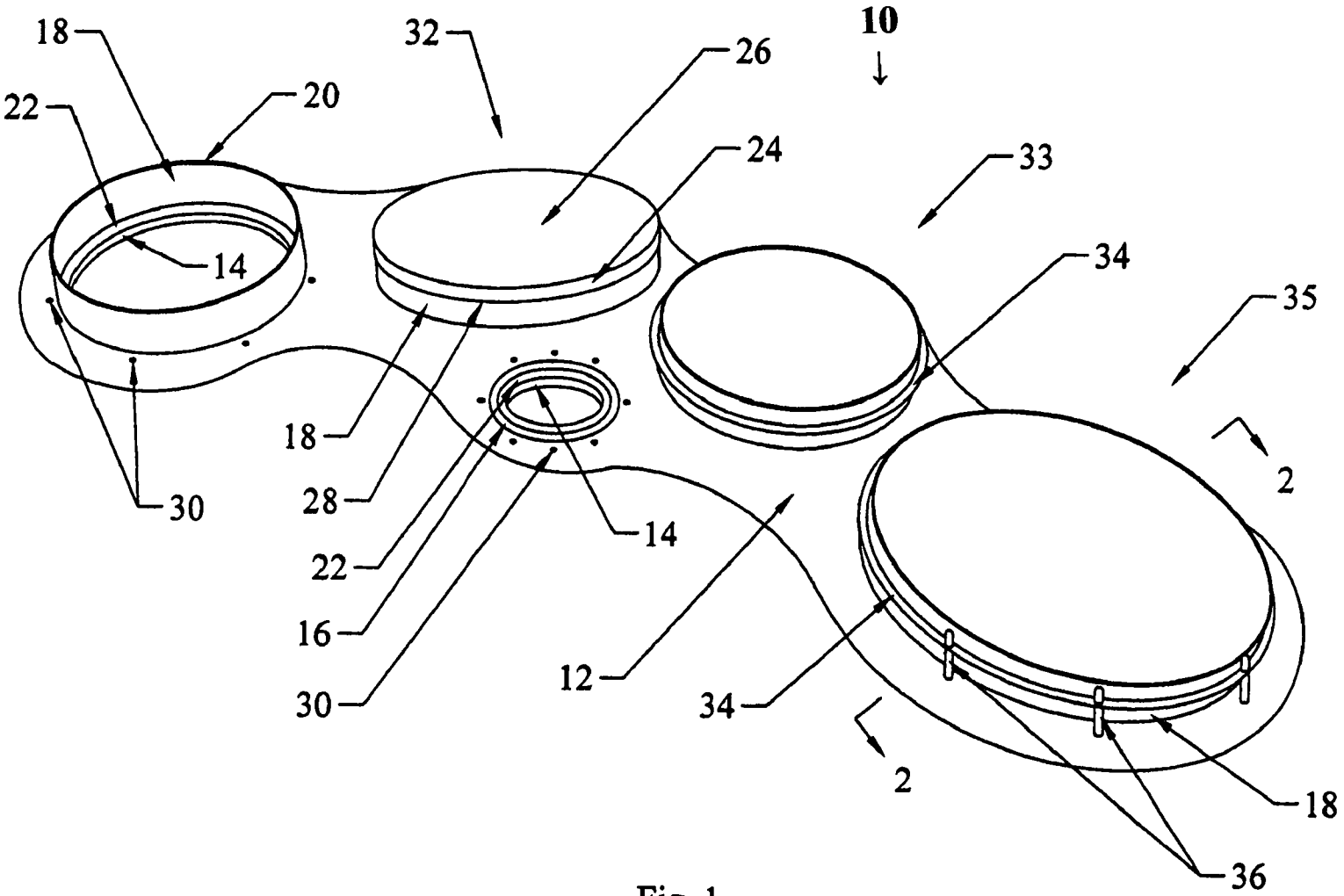
FIG. 1 is a perspective view of a 5-drum assemblage with a common base plate and, from the effects drum opening in front and then left to right, drums of the assemblage in increasing degree of assembly.

Illustrated in FIG. 1 is a partially assembled quad assemblage 10 of four primary drums and an effects ($5^{th}$) drum. The assemblage 10 begins with a base plate 12 that is to be common to the five drums assembled thereon. The initial base plates in according with the invention have been formed from wood, but other materials, such as metals or polymers may be used as well. The base plate 12 has five circular openings 14 of various sizes appropriate to the drums to be assembled thereover. As best seen relative to the front opening (effects drum opening), surrounding each opening 14 is an annular groove 16 that extends partially into the base plate. Each annular groove 16 serves to locate the drum shell 18 that is located therein. One such drum shell 18 is seen inserted in the annular groove 16 surrounding the left-hand opening. Each drum shell 18 is a hollow cylinder. At the upper end of each shell 18 is machined a bearing edge 20 for sealing with a drum head. If each groove 16 is precisely machined to firmly hold each shell 18, the groove may be sufficient for attachment of each shell; however, additional securing means, such as slots and corresponding beads may be further added to the bottom of each shell and within each groove to more securely and precisely locate each shell within its groove, as it is desired that each shell not shift position during playing of the instrument. Also, it is anticipated that each groove will be lined with a resilient polymeric liner (not shown) that will help to locate and secure the drum shell within the groove and also reduce drum-to-drum vibration through the common base plate.

It is to be noted that each annular groove 16 and each shell 18 that fits therein, has an interior diameter that is significantly larger than the diameter of the corresponding opening 14 in the base plate 12. This leaves an annular flange 22 that extends interior of each shell 18 and acts as the sound reflector in accordance with the invention. For purposes of the invention, the diameter of each opening 14 is such that the bottom opening of the drum shell is occluded, generally between 10% and 90% of the area, preferably between 20% and 80% of the area, and more preferably between 30% and 70% of the area.

In the second-from-left opening 14, the shell 18 has been inserted in the groove 16 and a drum head 24, consisting of a circular membrane 26 and a defining metal flange 28, located on the upper end of the shell. The bead 20 of the shell 18 provides a firm seal between the drum head and the shell. The drum head 24 is a stock drum part.

Figure 2:
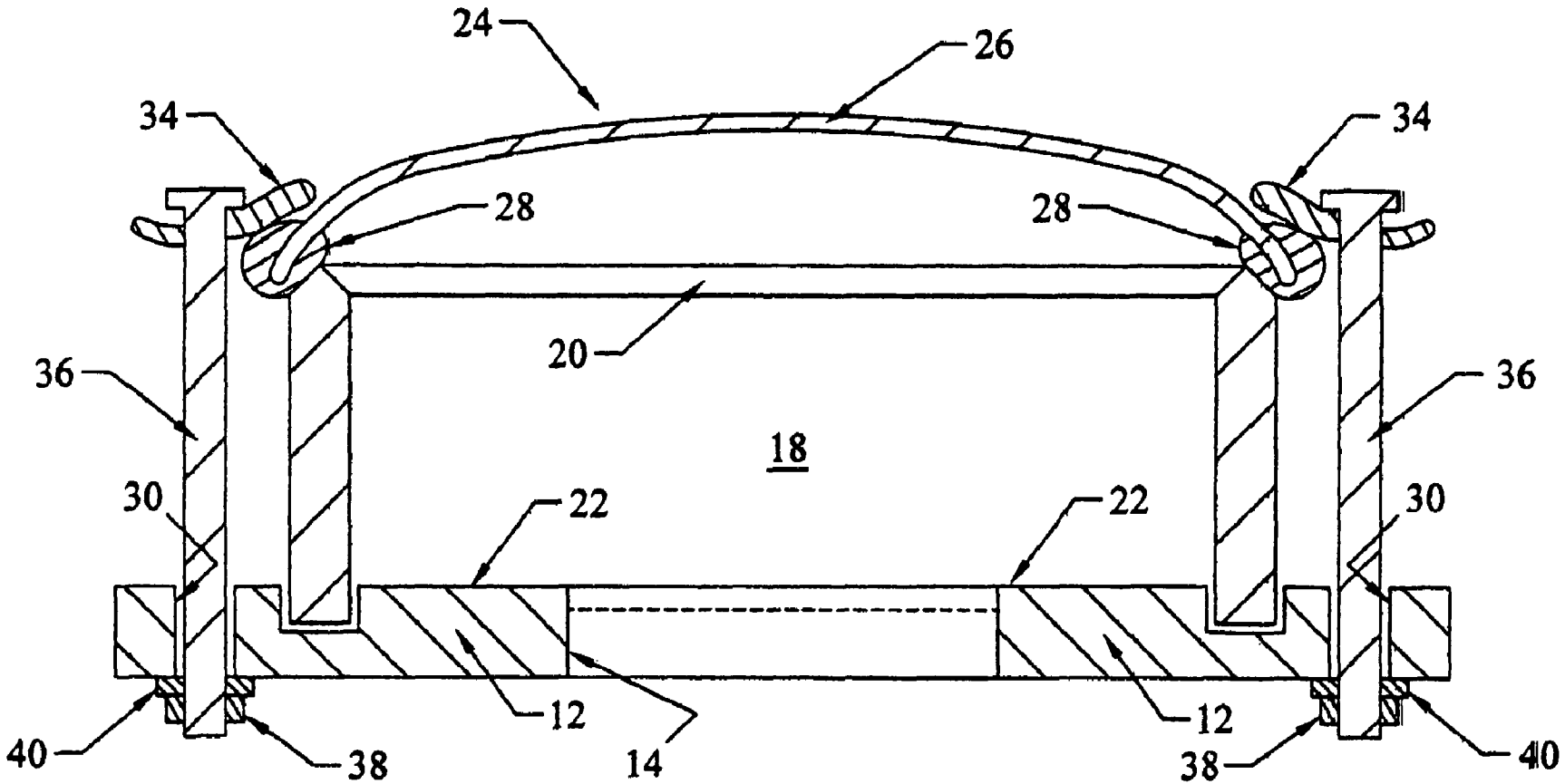
FIG. 2 is a cross-sectional view taken along line 2-2 of FIG. 1.

Surrounding each opening 14 and each grove 16 in the base plate 12 are a plurality, e.g., four to eight, through-bores 30 provided for securing each drum to the base plate. The drum 33 third from the left has a drum rim 34 (also a stock part) placed over the drum head 24. In the right hand completed drum 35, the rim 34 is secured to the base plate 12 by a plurality, e.g., eight, tension rods 36 that extend through the through-bores 30 and are held by nuts 38 and washers 40 to the bottom side of the base plate 12. A cross-sectional view of the completed (right-hand) drum is shown in FIG. 2.

At this point, certain advantages of the invention can be more fully appreciated. Each shell 18 has a low profile, relative to corresponding existing shells, typically having heights between about 6 and about 14 inches. As a result, each drum 35, as measured from the bottom of the base plate 12 to the top of each membrane 26 is between about 1 and about 4 inches, typically between about 1.5 and about 2.5 inches. Yet because of the reflector flange 22 of each drum 35, the sound quality of each drum is comparable to or improved relative to existing drums. It has been found, for example, that a case designed for a single conventional quad assemblage may hold four quad assemblages of the present invention. Furthermore, because the shells 18 are shorter than existing shells, the drum rim 34 is secured by tension rods 36 directly to the base plate 12, obviating the need for lug casings on the sides of the shells. The shortness, and corresponding lightness, of the shells, along with the elimination of lug casings results in a substantially lighter assemblage. In fact, prototype assemblages in accordance with the present invention have weights about half that of corresponding assemblages. Refinements in material selection will likely reduce the weight of these assemblages even further.

Figure 3:
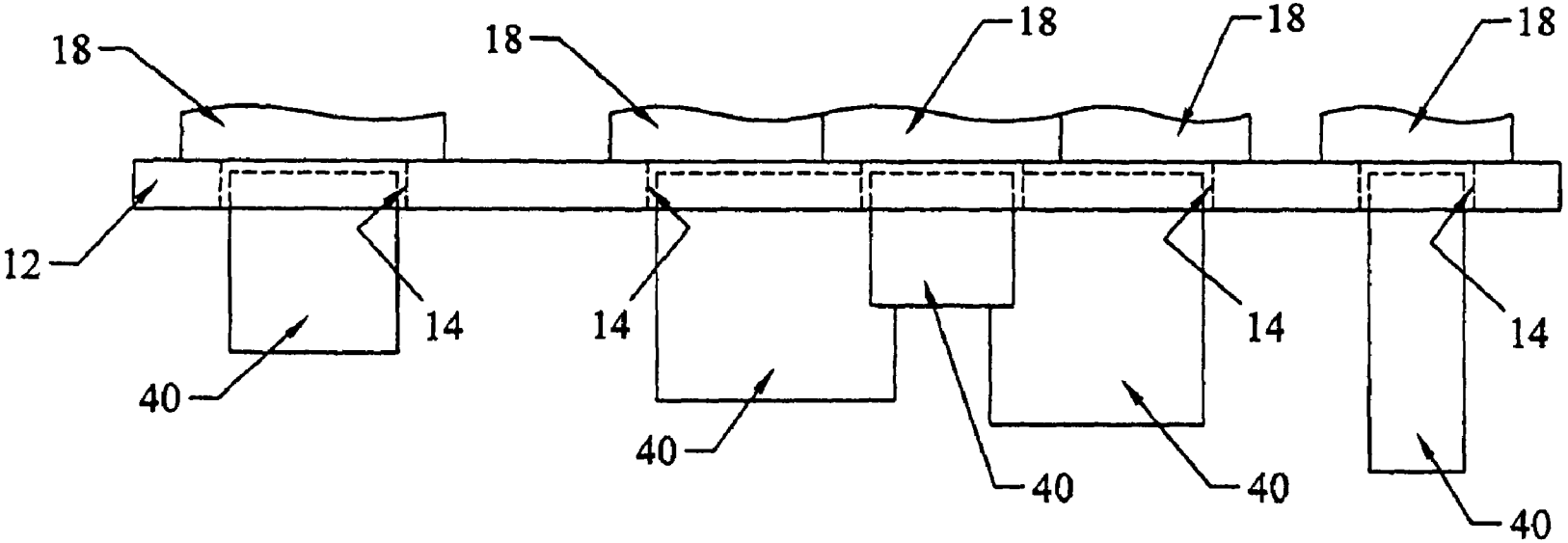
FIG. 3 is a side view of a base plate, such as illustrated in FIG. 1, showing extenders inserted in each base plate opening

While the reflector flange 22 of each drum 35 allows each drum to produce excellent sound without the height of conventional drums, and with reduced bulk and weight of each assemblage 10, it may be desirable to nevertheless provide a longer resonating chamber in certain circumstances. Thus in FIG. 3 is shown a side view of the base plate 12, and shell extenders 40. The exterior diameter of each extender 40 is matched to the interior diameter of the corresponding opening 14, whereby its upper end may be inserted into the opening. If precisely machined, each extender 40 may be held in the opening 14 by friction fit alone, although any of a variety of more secure attachment means, e.g., threads, bayonet mounts, resilient gaskets etc. may be used to more securely attach each shell extender 40 within each opening 14.

While all of the parts of the assemblage 10 are easily disassembled, the assemblage 10 is typically stored and transported with the individual drums 35 fully assembled. This, however, is not generally the case with the extenders 40 that may be used only in certain circumstances. These are intended to be removed during storage and transportation. Because each opening 14 in the base plate 12 is of different diameter, each extender 40 is of different diameter. This permits nesting of the extenders 40 during storage and transporting.

Figure 4:
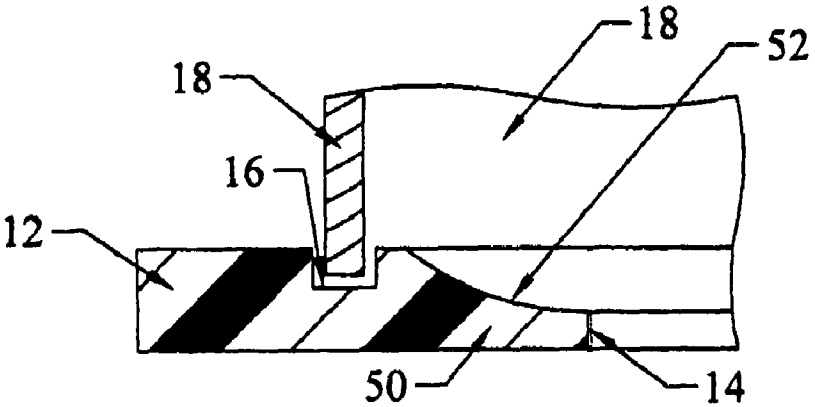
FIG. 4 is a partial cross-sectional view of an alternative embodiment of the invention in which the interior surface of the reflecting flange is molded or machined to have a concave, e.g., spherical or parabolic, reflecting surface.

In its simplest form, as illustrated in respect to FIGS. 1-3, the base plate 12 is formed of a piece of flat material, e.g., a flat piece of wood. This means that the flanges 22 that serve as sound reflectors, unaltered, have a flat upper surface. A flat reflector surface is not necessarily optimal for sound reflection. Illustrated in FIG. 4 is a partial cross-sectional view of the lower end of a shell 18 associated with a flange reflector 50 having a concave reflecting upper surface 52. The concave surface, that may be spherical, but perhaps preferably parabolic, reflects sound backward more toward the center of the membrane than does a flat surface.

Figure 5:
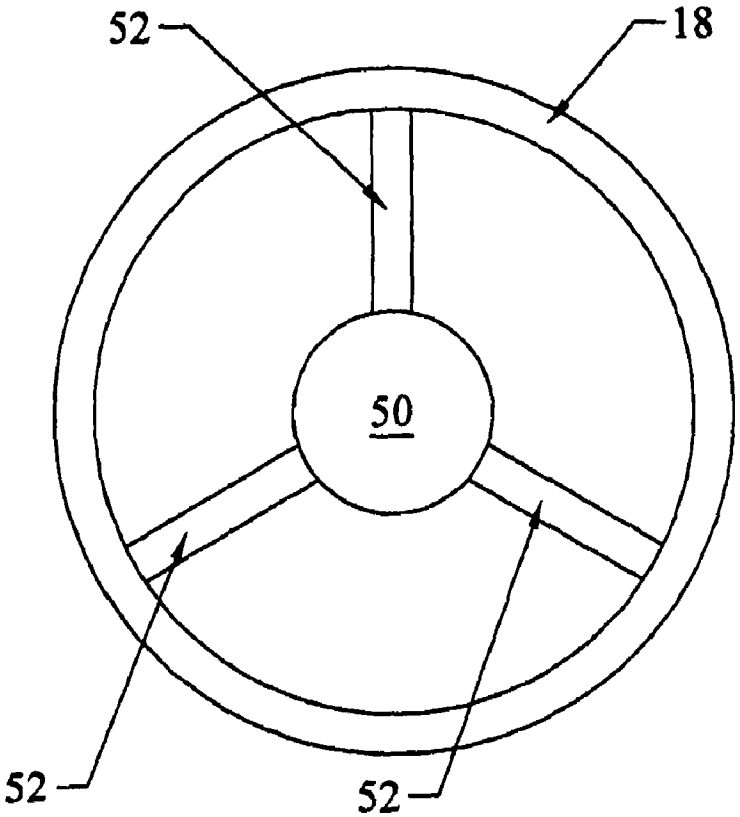
FIG. 5 is a view looking downward through a drum shell with yet another alternative embodiment of a sound reflector in accordance with the present invention.

While a reflecting flange is simple to provide in a flat base plate, it is not necessary that the reflector be a flange of the base plate. Looking downward through a shell 18 in FIG. 5 is a circular reflector 50 centered at the lower end of the shell opening. This reflector 50 is held in place by a plurality of struts 52 extending inward from the interior of the shell. The struts and reflector may be machined from the base plate, or may be add-on parts. The upper surface 54 of the reflector may be flat, spherical or parabolic, concave or convex, or otherwise shaped as determined empirically to produce optimal sound. As in the case of the flange, the reflector 50 typically occludes the opening by about 10% to 90% of the area, preferably 20% to 80% of the area, and more preferably 30% to 70% of the area. The exact area of occlusion may be determined empirically.

The initial prototypes of drums and assemblages of the present invention have base plates that have been made of wood, although, as noted, other materials may be used, such as plastics and metals. To withstand weather, base plates, if made of wood, are preferably coated with a protecting material. A currently preferred protecting material for wood base plates is sold under the trademark Line-X.

The shells of drums are almost always circular in cross-section. Most commonly they are cylindrical, although drums, such as bongo drums, are known that have frustoconical shells. When other than cylindrical, the diameters and areas of the shells relative to the reflectors are measured at the lower ends of the shells. Likewise, extenders could be frustoconical rather than cylindrical, in which case, for fitting with base plates, it is their upper diameters which are relevant.

Various features of the invention are set forth in the following claims.

What is claimed is:

1. An assemblage of a plurality of drums comprising a plurality of drum shells each having a circular cross-section with an upper opening and a lower opening, a sounding membrane covering the upper opening of each of said drum shells, a common base plate having a plurality of openings and means associated with each of said openings for seating a drum shell therein, and means for connecting each of said sounding membranes to each of said drum shells tensioned directly to said common base plate, the assemblage further including sound reflectors partially occluding the lower openings of each of said drum shells so as to direct sound waves back toward said sounding membrane.

2. The assemblage of claim 1 wherein said sound reflectors are integral with said common base plate.

3. The assemblage of claim 1 wherein each of said openings of said base plate are smaller than the corresponding lower opening of each of said drum shells, whereby an annular flange of said base plate partially occludes each of said lower openings, thereby providing the sound reflector.

* * * * *